US010551150B1

(12) United States Patent
Seuk

(10) Patent No.: US 10,551,150 B1
(45) Date of Patent: Feb. 4, 2020

(54) BODY ARMOR PLATE

(71) Applicant: Jo Won Seuk, Fayetteville, NC (US)

(72) Inventor: Jo Won Seuk, Fayetteville, NC (US)

( * ) Notice: Subject to any disclaimer, the term of this patent is extended or adjusted under 35 U.S.C. 154(b) by 1263 days.

(21) Appl. No.: 14/719,426

(22) Filed: May 22, 2015

Related U.S. Application Data

(63) Continuation-in-part of application No. 14/481,836, filed on Sep. 9, 2014, now Pat. No. 9,441,916.

(51) Int. Cl.
*F41H 5/02* (2006.01)
*F41H 1/00* (2006.01)

(52) U.S. Cl.
CPC ..... *F41H 1/00* (2013.01)

(58) Field of Classification Search
CPC ..... F41H 1/02; F41H 1/00
See application file for complete search history.

(56) References Cited

U.S. PATENT DOCUMENTS 3,873,998 A * 4/1975 Norris ..... B32B 9/00 2/2.5
5,072,453 A * 12/1991 Widder ..... F41H 1/02 2/102
9,144,255 B1 * 9/2015 Perciballi ..... A41D 27/00
9,441,916 B2 * 9/2016 Seuk ..... F41H 1/02
2009/0084256 A1 * 4/2009 DeCristofaro ..... F41H 5/023 89/36.02
2012/0132066 A1 * 5/2012 Seuk ..... F41H 1/02 89/36.05
2014/0201879 A1 * 7/2014 Seuk ..... F41H 1/02 2/2.5
2014/0259249 A1 * 9/2014 Milligan ..... F41H 1/02 2/2.5
2015/0285594 A1 * 10/2015 Seuk ..... F41H 1/02 2/2.5
2015/0323289 A1 * 11/2015 Seuk ..... F41H 1/02 89/36.05
2016/0169632 A1 * 6/2016 Holtz ..... F41H 5/0428 89/36.02

FOREIGN PATENT DOCUMENTS

WO WO-2008109069 A1 * 9/2008 ..... B60N 2/60

* cited by examiner

*Primary Examiner* — Gabriel J. Klein
(74) *Attorney, Agent, or Firm* — R. Tracy Crump

(57) ABSTRACT

A body armor plate having an integral Molle compatible front covering that allows pouches and other Molle compatible accessories to be directly affixed to the plate. The armor plate includes a ballistic core, an integral front covering of durable fabric having a plurality of horizontal slits arranged in a Molle compatible array and a rear covering of hook or loop pile fabric material. The array of slits in the integral front cover of the armor plate allows Molle compatible pouches to be directly attached to the plate, thereby eliminating the need for a separate plate carrier or vest and greatly reduces the overall weight and bulk of the personal armor system. The hook and/or loop pile material of the integral back covering of the armor plate itself allows support straps to be connected directly to the plate without additional support or carrier apparatus needed to hold the plates to a wearer.

1 Claim, 5 Drawing Sheets

BODY ARMOR PLATE

This application is a continuation-in-part of U.S. patent application Ser. No. 14/481,836 filed on Sep. 9, 2014, the disclosure of which is hereby incorporated by reference.

This invention relates armor plate carriers for personal body armor, and in particular a body armor plate and carrier system using hook and loop fasteners to secure the plates to the carriers.

BACKGROUND AND SUMMARY OF THE INVENTION

Rigid ballistic armor plates, also known as rifle plates, are cloth covered plates of ballistic material, such as hardened steel, ceramic composites, or thermally formed and bonded layered ballistic fabric. Armor plates are used as inserts in specialized garments, called plate carriers, that suspend and position the plate on the wearer's body. Plate carriers are well known in the military and law enforcement communities. Heretofore, plate carriers have used internal pockets or pouches to support the ballistic plates. The use of pockets and pouches simply to support the weight and bulk of the ballistic plates within the carrier adds significant bulk and weight to the wearer. Due to the equipment loads carried, reducing the weight of the plates and the plate carriers is always beneficial to military and law enforcement personnel.

The present invention provides for body armor plates having an integral Molle compatible front covering that allows pouches and other Molle compatible accessories to be directly affixed to the plate. The armor plate includes a ballistic core, an integral front covering of durable fabric having a plurality of horizontal slits arranged in a Molle compatible array and a rear covering of hook or loop pile fabric material. The array of slits in the integral front cover of the armor plate allows Molle compatible pouches to be directly attached to the plate, thereby eliminating the need for a separate plate carrier or vest and greatly reduces overall weight and bulk of the personal armor system. In addition, the hook and/or loop pile material of the integral back covering of the armor plate itself allows support straps to be connected directly to the plate without additional support or carrier apparatus needed to hold the plates to a wearer.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 2:
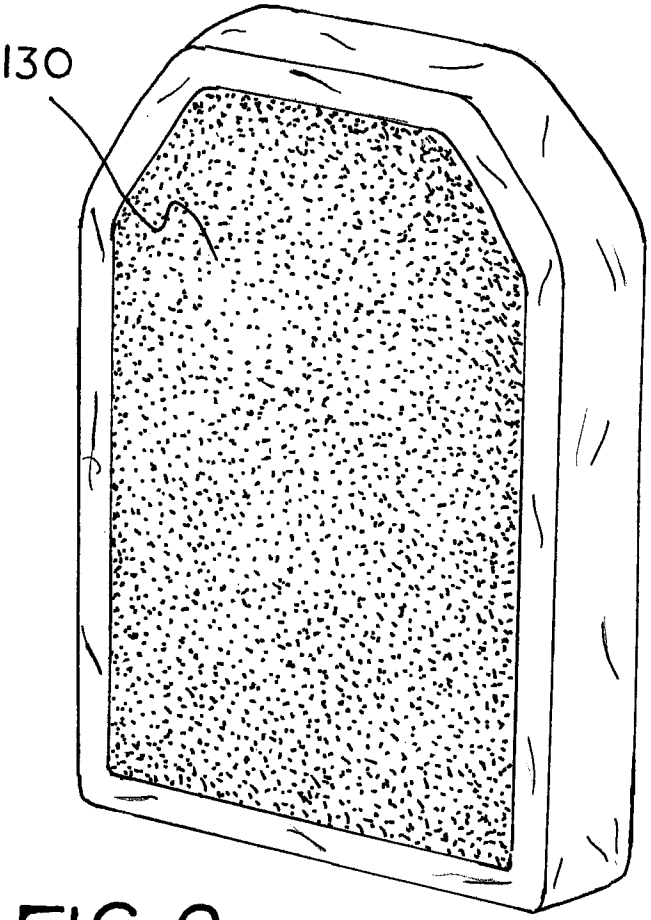
FIG. 2 is a rear perspective view of the armor plate of FIG. 1.
Figure 1:
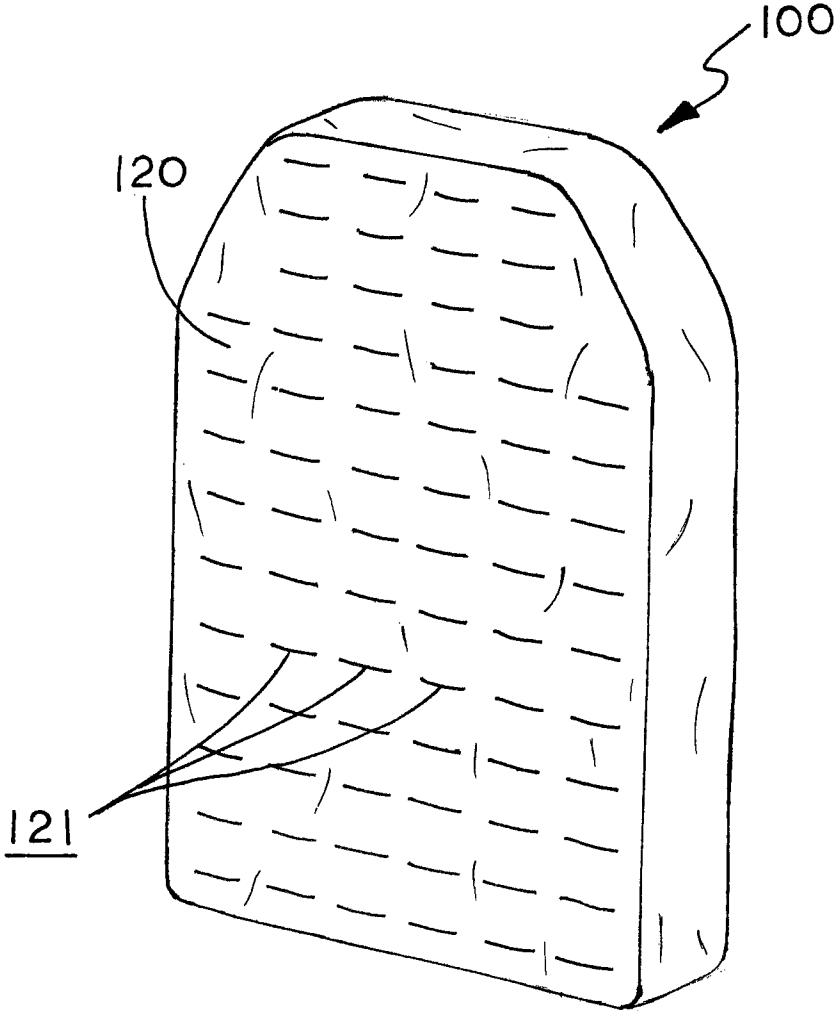
FIG. 1 is a front perspective view of an exemplary embodiment of an armor plate of this invention.
Figure 4:
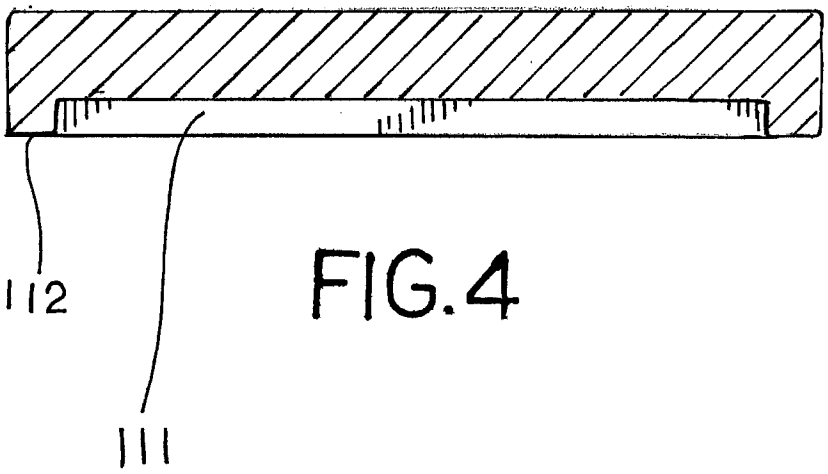
FIG. 4 is a sectional view of the inner ballistic core of FIG. 3 taken along line 5-5.
Figure 3:
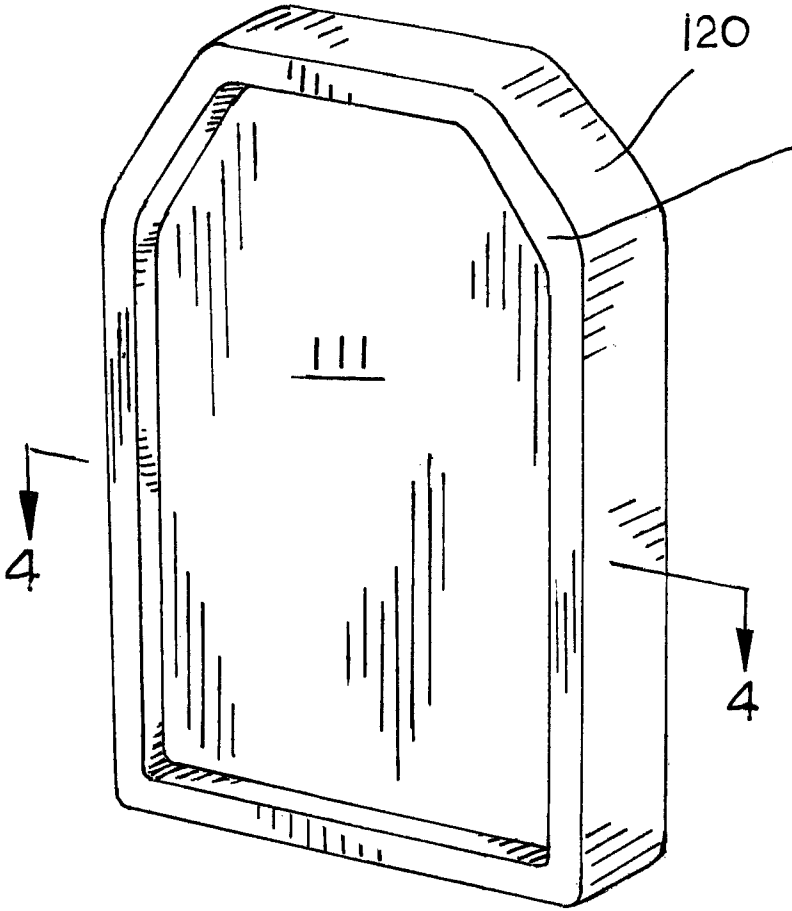
FIG. 3 is a front perspective view of the inner ballistic core of the armor plate of FIG. 1.

Referring now to the drawings, FIGS. 1-7 illustrate an exemplary embodiment of the armor plates of this invention, which is designated as reference numeral 100. Armor plate 100 includes a ballistic plate core 110 and has an integral front covering 120 of durable fabric having a plurality of horizontal slits 121 arranged in a Molle compatible array and a rear covering 130 of hook or loop pile fabric material. The ballistic plate core 110 is of conventional design and may be composed of multiple layers of ballistic material, such as Dupont's Kevlar® bonded together. Alternatively, the ballistic core may be composed of a solid metal or ceramic plate. The composition and construction of ballistic plate core 110 is well known in the art and therefore, not discussed in great detail here. Generally, ballistic plate core 110 is shaped and configured to overlie a human torso. As shown, ballistic plate core 110 is shaped in a pentagon and has a slight convex front face and a concave rear face. The ballistic plate core may take other shapes and forms in alternative embodiments. As shown in FIGS. 3 and 4, the front face of ballistic core 110 has a recessed area 111 defined by a peripheral edge 112. Recess 111 is approximately ⅛-¼ inches deep, which allows Molle fasteners to extend through slits 121 under or behind the front cover 120 without deforming or overly stretching the material of front cover 120. Recess 111 allows armor plate 100 to maintain a smooth flat forward face when multiple pouches and accessories are affixed to the plate.

The front cover 120 is a constructed of a durable material, such as Codura nylon or Heplon. Front cover 120 wraps over the front and around the sides of ballistic core 110 and is permanently bonded to the ballistic core by a suitable adhesive. As shown, front cover 120 has a plurality of horizontal slits 121 arranged in an array of aligned vertical columns and horizontal rows. The array of horizontal slits 121 are arranged to create a Molle compatible array, which allows other Molle compatible pouches and accessories to be affixed directly to armor plate 100. Slits 121 are approximately 1" in length and allow Molle fasteners, such as Alice Clips to be inserted and woven vertically through adjacent slits 121. Ideally, slits 121 are laser cut in the cover material to prevent fraying.

Back cover 130 is either loop fastener pile material or hook fastener pile material, which is similarly bonded to the back of ballistic core 110 over the edges of front cover 120 by a suitable adhesive. The integral hook and/or loop pile material of the back covering of the armor plate itself allows support straps to be connected directly to the plate without additional support or carrier apparatus needed to hold the plates to a wearer. Hook and loop fastener materials, such as that commonly available from Velcro Industries B.V. LLC. under the trademarked brand VELCRO®, are well known to those skilled in the art. The use of hook and loop fastener materials to directly affix and support the armor plates to the carrier apparatus eliminates the needed for enclosed internal pouches or pockets, thereby greatly reducing overall weight and bulk of the armor plate carrier system. Integrating hook and loop fastener materials into the covering of armor plates also allows the armor plates to be suspended for a wearer with only shoulder straps, harnesses and cummerbunds having corresponding hook and loop fastener materials.

Figure 5:
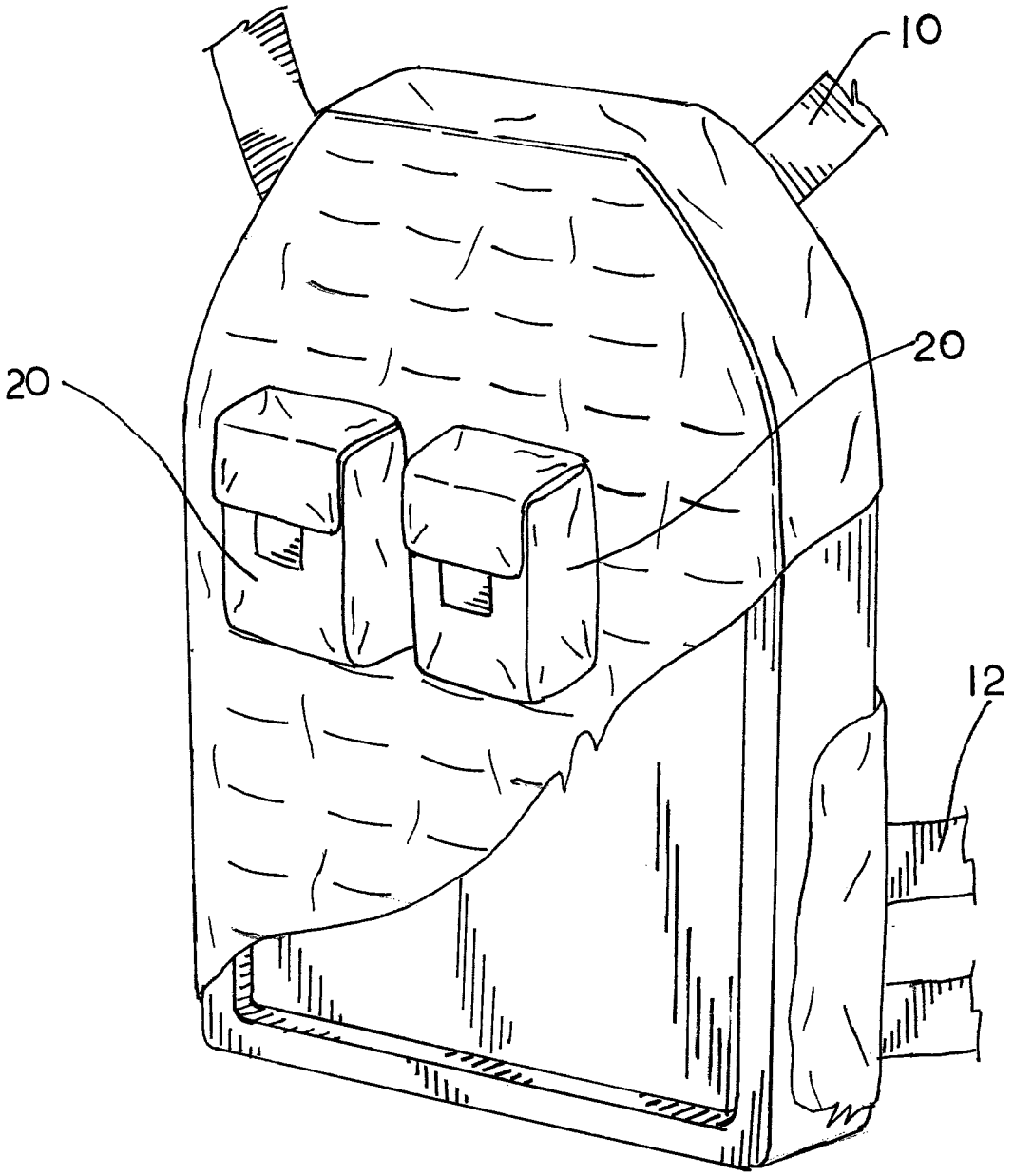
FIG. 5 is a front perspective view of the armor plate of FIG. 1 having a portion cut away to show the inner ballistic core, and partially shown with shoulder and side straps and Molle pouches.
Figure 7:
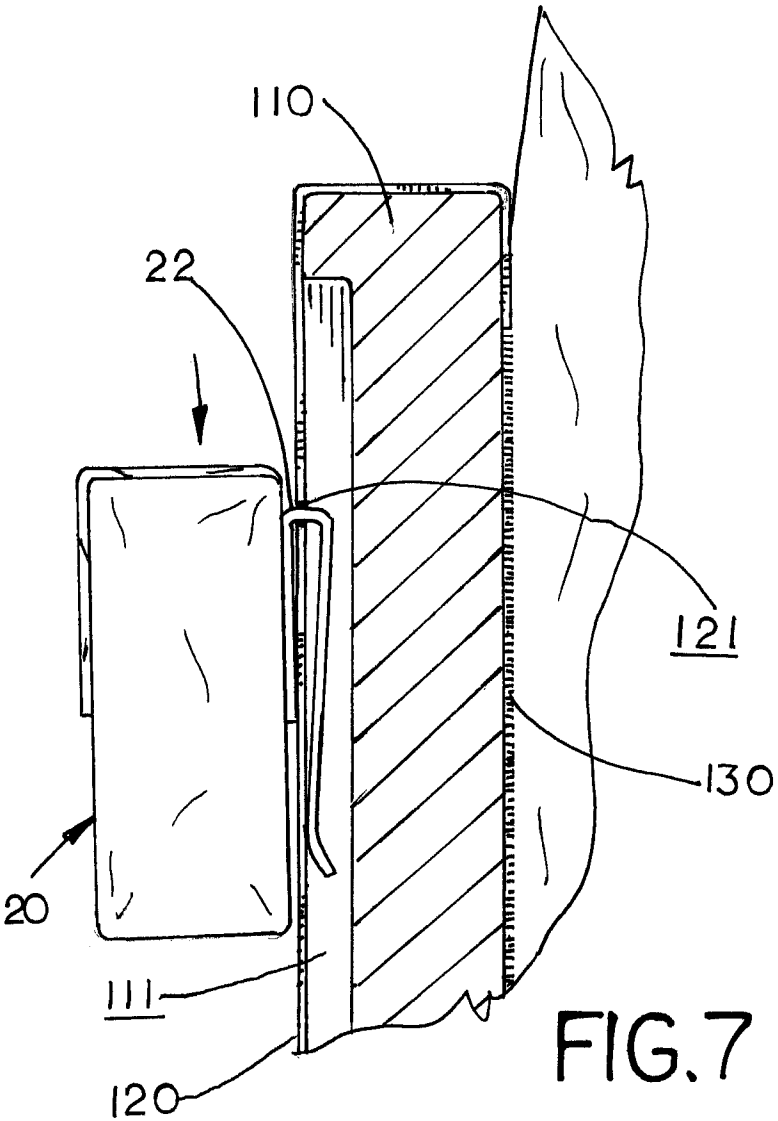
FIG. 7 is a partial side sectional view of the armor plate of FIG. 1 shown with Molle pouches fitted to the plate.
Figure 6:
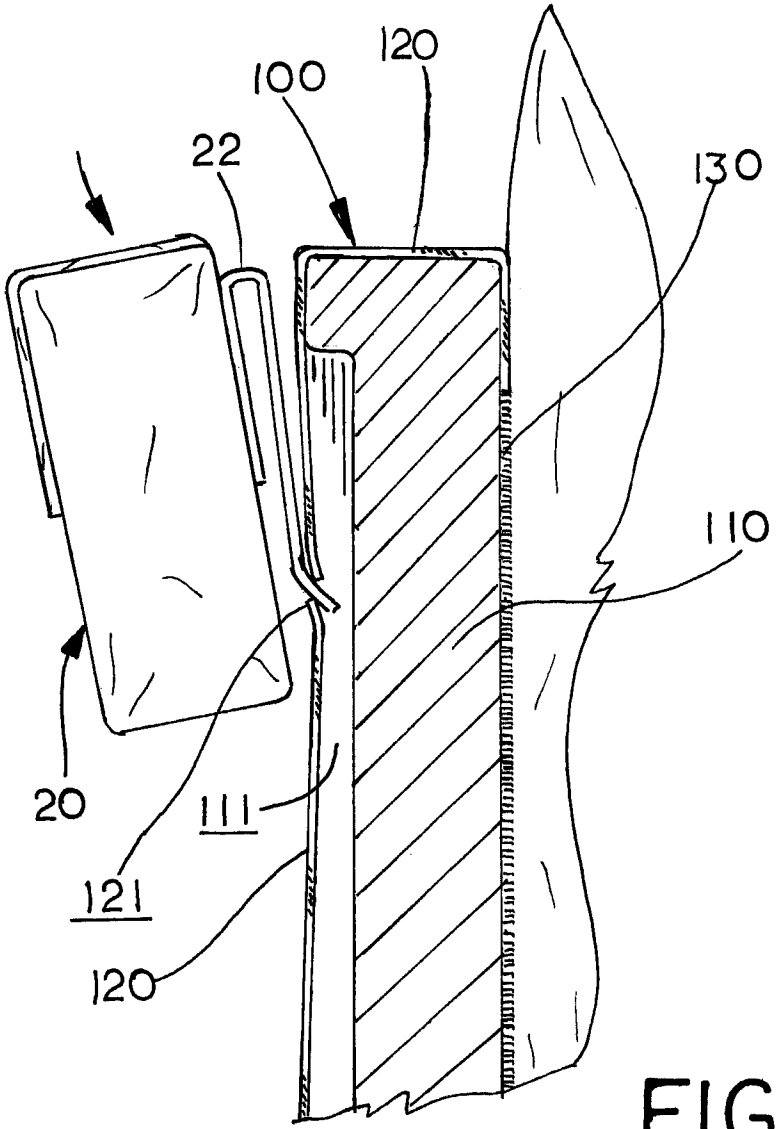
FIG. 6 is a partial side sectional view of the armor plate of FIG. 1 shown with Molle pouches being fitted to the plate.

Armor plate 100 may be adapted for use in a variety of straps and harnesses, as well as adapted to support a variety of Molle Compatible pouches and accessories. FIG. 5 shows shoulder straps 10 and waist straps 12 secured to the back of armor plate 100 using the engagement of mating hook and loop fasteners (not shown). FIGS. 5-7 show how exemplary Molle compatible pouches 20 are attached to the front of armor plate 100 using conventional Molle fasteners 30. As shown, Molle fasteners 30 extend through and are woven between adjacent slits 121 to hold the pouches at selective positions on the front of armor plate 100.

Figure 9:
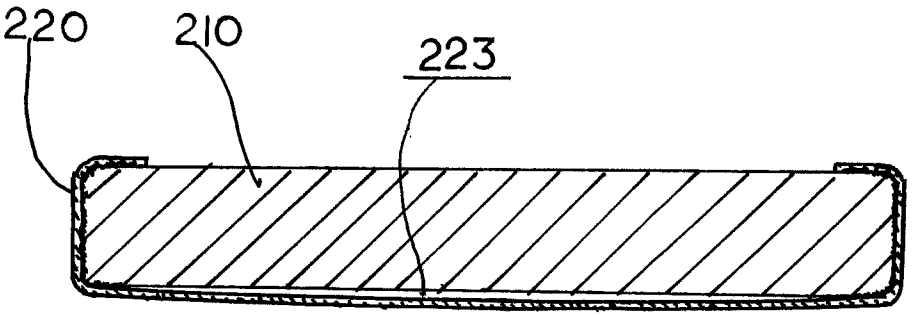
FIG. 9 is a top sectional view of the armor plate of FIG. 8.
Figure 8:
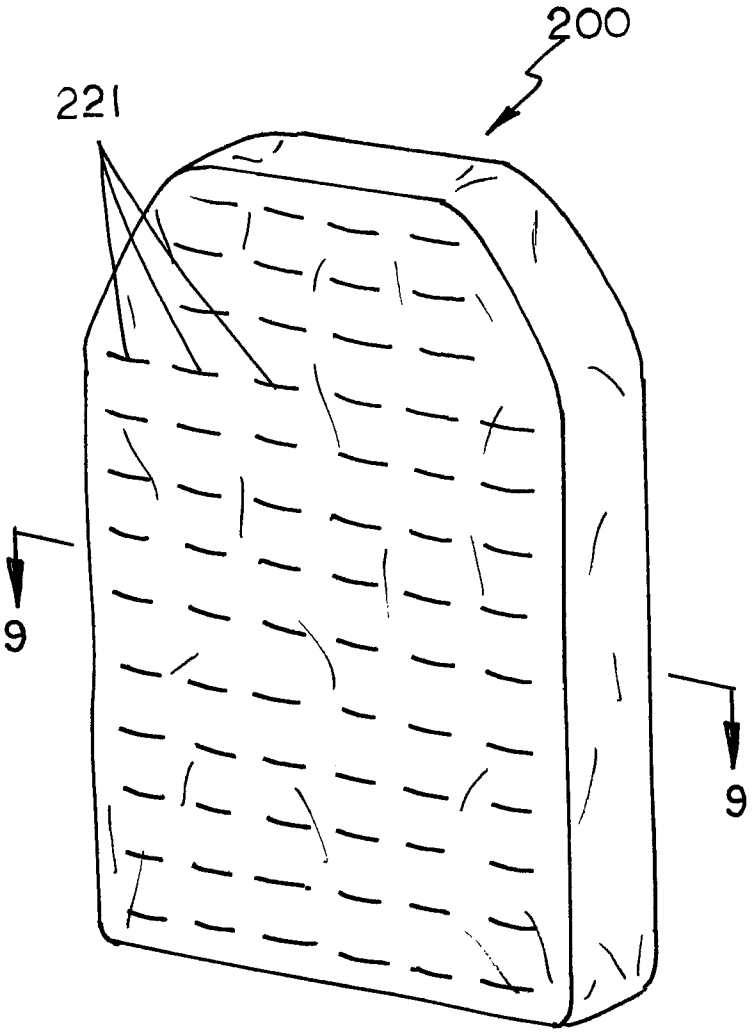
FIG. 8 is a front perspective view of a second embodiment of an armor plate of this invention.

FIGS. 8 and 9 illustrate an alternative embodiment of an armor plate of this invention designated generally as reference numeral 200. Armor plate 200 is similar to armor plate 100 above, but the plate core 210 does not have a front recess. Instead, front covering 220 is adheared to plate core 210 with sufficient slack to provide a gap 223 between the cover and core. Again, front cover 220 has a plurality of horizontal slits 221 arranged in an array of aligned vertical columns and horizontal rows, which allows other Molle compatible pouches and accessories to be affixed directly to armor plate 100. Gap 223 is sufficient to allow Molle fasteners and straps to be interwoven between adjacent slit of a vertical column when affixing a Molle compatible pouch or accessory to armor plate 200.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A body armor plate comprising:

a ballistic plate core having a peripheral edge, a front face and a rear face, the front face of the plate core has a continuous recessed area formed therein, the continuous recessed area constituting a majority of the front face;

an integral front covering bonded to the plate core and overlying the front face of the plate core and wrapping around the peripheral edge of the plate core, the front covering having a plurality of horizontal slits formed therein and arranged in an array of vertical columns and horizontal rows such that the array of slits is configured for interconnection with Molle compatible pouches and accessories, the front cover is spaced over the recessed area of the front face of the plate core to receive the interconnection with the Molle compatible pouches and accessories between the front cover and the front face of the plate core; and an integral back covering bonded to the plate core and overlying the rear face of the plate core, the back covering being of hook and loop fastener material integrally bonded to the rear face of the plate core.

* * * * *